United States Patent [19]

Queen

[11] 4,134,471

[45] Jan. 16, 1979

[54] NARROW ANGLE CYLINDRICAL WAVE FULL RANGE LOUDSPEAKER SYSTEM

[75] Inventor: Daniel L. Queen, Chicago, Ill.

[73] Assignee: Chamberlain Manufacturing Corporation, Elmhurst, Ill.

[21] Appl. No.: 846,366

[22] Filed: Oct. 28, 1977

Related U.S. Application Data

[63] Continuation of Ser. No. 712,881, Aug. 9, 1976, abandoned.

[51] Int. Cl.[2] ..... H04R 1/20

[52] U.S. Cl. ..... 181/147; 181/145; 181/146; 181/152; 181/195; 181/199

[58] Field of Search ..... 179/1 E, 115.5 H; 181/144, 145, 146, 147, 148, 149, 150, 151, 152, 153, 154, 155, 156, 159, 195, 199

[56] References Cited

U.S. PATENT DOCUMENTS 3,816,672 6/1974 Gefvert et al. ..... 179/1 E

*Primary Examiner*—George G. Stellar

*Attorney, Agent, or Firm*—Hill, Gross, Simpson, Van Santen, Steadman, Chiara & Simpson

[57] ABSTRACT

A loudspeaker system which has a frequency response at any angle located about the speaker system which will be uniform such that the output sound pressure at any frequency from the speaker system will be as great or greater than the sound pressure from any other direction which comprises a reflected path from the speaker system. The speaker system includes a radial horn which radiates a spherical sector rotated 360° through a horizontal plane is provided. One or two speakers are mounted so that they produce a pulsating cylindrical wave which feeds into the radiator and an inverted conical member is mounted in the transition portion between the pulsating cylinder and the output horn portion. This output is blended with similar wavefronts produced by a low fequency loudspeaker which is acoustically associated with a vented box. The vent is on the periphery of the box adjacent the low frequency loudspeaker and is narrower than the thickness of the walls of the box. The speakers are vertically arranged in a very compact space.

7 Claims, 8 Drawing Figures

NARROW ANGLE CYLINDRICAL WAVE FULL RANGE LOUDSPEAKER SYSTEM

This is a continuation, of application Ser. No. 712,881, filed Aug. 9, 1976, now abandoned.

BACKGROUND OF THE INVENTION

1. Field of the Invention

This invention relates in general to a loudspeaker system and in particular to an improved loudspeaker system which includes two drivers coupled to a horn by means of acoustical coupling networks.

2. Description of the Prior Art

It has been difficult if not impossible in speaker systems of the prior art to eliminate frequency distortion which varies as a function of the radiating angle from the speaker system. Such distortion results from the relationship of the wavelength to the diameter of the piston and in multiple driver systems to the spacing and positioning of the pistons. Although it has been proposed to solve this problem of frequency distortion by having the virtual size of the radiators decrease with frequency such solution has not eliminated frequency distortion as a function of radiating angle. The sound pressure (ignoring distance) radiated by a piston in a plane wall is:

$$p(\theta) = 2J_1[F(\theta)]/F(\theta)^2$$

$$F\theta = ka \sin \theta$$

Where $\theta$ is the angle away from the axis; $k = \omega/c$; $c$ = velocity of sound in air; and "a"=radius of the piston. $J_1$ is the type 1 Bessel function of order 1 and argument $F(\theta)$. This function has the appearance of a damped sinusoid varying with $\theta$; thus influencing $p(\theta)$ proportionally, resulting in directional lobes when ka is large.

Assuming point sources the pressure (ignoring distance) of a number (n) of such sources and at a distance much greater than the extent between them is:

$$p(\theta) = \sin[n\pi m f \sin\theta/c]/[n \sin(\pi m f \sin\theta/c)]$$

where f is the frequency and m is a factor including the extent between the sources. The function exhibits the periodic nulls characteristic of a sin x/x function. Even when delays are introduced electrically into the factor m, to reduce the frequency variance on-axis, off-axis lobes must still occur.

Thus, in multiple radiator systems it is inevitable and unavoidable that lobes and nulls will appear in the directivity characteristic at any one frequency and that these lobes and nulls will not coincide as frequency is changed. In a monaural music reproduction system, this problem is not too serious if one is positioned reasonably within the coverage angle of the loudspeakers. However, even in this case there will be some frequency distortion if the power response of the speaker does not reasonably follow the response on the listener's axis, since, assuming uniform diffusion, the mean square sound pressure at the listener on sustained signals will be:

$$p^2(r) = W\rho_o c[1/(4\ r^2) + 4/R]$$

where $\rho_o$ = density of air; R = room constant, a function of room size and acoustic absorption; W = total power emitted by the radiator.

The term $1/(4\pi r^2)$ represents the direct sound; however, if the radiator is characterized by the directivity equations, the term becomes $Q_D/(4\pi r^2)$, where $Q_D$ represents the position of the listener on the lobed direction pattern — and is frequency variant.

The direct sound term can therefore, as a function of frequency, fall well below the reflected sound term, 4/R, or at least below early reflections, resulting in an unnatural smearing of the frequency components of the sound, both in space and time.

Moreover, in stereo systems, where virtual sources not coinciding with the loudspeaker position must be produced, the problem can be unusually serious.

SUMMARY OF THE INVENTION

A stereo system produces a virtual image by taking advantage of the localization ability of human hearing. Human hearing localizes by analyzing the differences in arrival times between the two ears. If coherent sounds are generated so as to originate from two different sources separated in space and arrive at a listener within about one millisecond of each other, the listener will perceive an image between the two sources, with its position dependent on both the amplitude and the relative time of arrival of the sounds. As the arrival time difference increases to over a millisecond and less than approximately 65 milliseconds, the image position will no longer be affected by arrival at a later time. The late sound will affect mainly the perceived amplitude of the image.

The temporal response of the hearing sensor thus described affects creation of a stereo image from a pair of loudspeakers. If the frequency response, $p(\theta, f)$, on the listener's axis from each loudspeaker is not the same from both speakers, there will be unintended amplitude differences which vary with frequency. Thus, the apparent position of the source will vary with frequency.

If the amplitude at any frequency on the listener's axis from the speaker is substantially less than the amplitude from a reflection, the listener's localization will be directed to the reflecting surface, rather than to the loudspeaker.

The result will be a blurring and wandering of the stereo image. It is therefore desirable to design a loudspeaker such that its frequency response toward any angle in which a listener can be placed will be uniform or stated differently, its output sound pressure at any frequency will be no greater in any other direction than it is in the direction toward the listener.

Conceivably this could be achieved by radiating only into that segment of a sphere about the speaker in which people could be placed. However, achievement of such directivity at all frequencies, with the desired uniformity, is not practical at the present state-of-the-art.

However, a radiator which can produce radiation describing a spherical sector rotated 360° through one horizontal plane is feasible. This meets the desired requirements because the reflected signals from the back side of the radiator arrive at the listener at a lower amplitude than the signals radiated directly due to the attenuation associated with longer paths lengths, and the absorption of the surfaces from which they were reflected — since the total reflected energy must be less than 100%.

A radiator of the invention includes a radial horn, with a driving element comprising a pulsating cylinder and the horn area developed along the radius of a circular plane. The present invention utilizes a cylindrical driver, and a practical approach utilizes a cylindrical throat with a diaphragm — dome-shaped or conical — operating as a piston loaded into a volume of air enclosed between the diaphragm and the throat.

The high frequency response of such a system is limited by the compliance of the air in such volume. To reduce the volume, the horn may be folded by allowing the area of the horn to expand first along a straight line and then along a radius. The throat may then be circular, conforming to the diaphragm.

At the transition between the straight and the radial horn development, there is a section where the radius of the straight development equals the height of the radial development. At that point an error in the development of the volume of the horn will occur which is equal to the volume of a conical section and which may be compensated for by placing a cone in the volume.

No change in area will take place at this point but there will be a delay in the path length depending on the position along the height of the horn. This path length delay may be compensated by making one side of the radial section of the horn straight while the other is curved with the conical section is on the straight side.

A practical horn of the type described must be of a size compatible with placement in normal listening rooms, if the horn is to be useful as a home entertainment high quality loudspeaker. This limits both the total length and the mouth area of the horn, and in the invention a method was found to minimize the effect of reflections from the mouth in a horn which has sufficient length such that its cutoff frequency can be low enough to be useful. This may be accomplished by optimizing the flare constant and the cutoff frequency within a limited range in the following series of expressions:

$H = c/(2\pi f_c)$, $f_c$ = horn cutoff frequency $w = 2\pi f$ $l_p = 1 + 8A/(3\pi)$, 1 = horn length, A = mouth area $T = -j(c/(wH))\,(1 - (wH/c)^2)^{\frac{1}{2}}$ $Z_T = p_o c/T \coth\,[\pi(a + jB) + (j\,w\,T\,l/c)] - j\,c\,\tanh$ $\epsilon$ $a \approx [T/(2\pi)]\,(A\,w/c)^2$ $B = (8\,T(3\pi^2))\,(A\omega/c)$ By iterating while varying the shape factor, $\epsilon$, and the horn cutoff (over a narrow range of frequency) a horn can be optimized for minimum least-squares variation of $Z_T$, the throat impedance over the desired pass band.

The horn shape is then computed by calculating the area ($S_T$) at each increment of length (l) from the throat to the mouth of the horn:

$$S_T = \pi\{a/[\cosh l + \epsilon\cosh l \tanh (l\pi f_c/c_0)]\}^2,$$

where a = mouth radius

At the throat, the radius of a circular section is calculated at each increment of length. After the fold, the height of a cylinder having area $S_T$ is calculated for each increment.

For a radial horn having a 0.3 meter diameter with a cutoff of about 600 Hz the characteristics are according to the following printouts.

HORN THROAT IMPEDANCE

FOR HORN HAVING
LENGTH=0.150000 Meters
MOUTH RADIUS=0.150000 Meters
SCALE FACTOR=0.778914E-01 Meters
SHAPE FACTOR=0.522318E 00 Meters Frequency $f_c$=704.936

| FREQ | REAL PART | IMAG PART | MAGNITUDE | PHASE IN RADIANS |
|---|---|---|---|---|
| 20. | 0.999998E-36 | 0.757202E 01 | 0.757202E 01 | 0.157080E 01 |
| 22. | 0.999998E-36 | 0.847866E 01 | 0.847866E 01 | 0.157080E 01 |
| 25. | 0.999998E-36 | 0.946010E 01 | 0.946010E 01 | 0.157080E 01 |
| 28. | 0.999998E-36 | 0.105914E 02 | 0.105914E 02 | 0.157080E 01 |
| 32. | 0.999998E-36 | 0.119096E 02 | 0.119096E 02 | 0.157080E 01 |
| 36. | 0.999998E-36 | 0.134137E 02 | 0.134137E 02 | 0.157080E 01 |
| 40. | 0.999998E-36 | 0.151023E 02 | 0.151023E 02 | 0.157080E 01 |
| 45. | 0.999998E-36 | 0.169736E 02 | 0.169736E 02 | 0.157030E 01 |
| 50. | 0.999998E-36 | 0.188393E 02 | 0.188393E 02 | 0.157080E 01 |
| 56. | 0.999998E-36 | 0.210698E 02 | 0.210698E 02 | 0.157080E 01 |
| 63. | 0.999998E-36 | 0.236595E 02 | 0.236595E 02 | 0.157080E 01 |
| 71. | 0.999998E-36 | 0.266008E 02 | 0.266008E 02 | 0.157080E 01 |
| 80. | 0.999998E-36 | 0.298840E 02 | 0.298840E 02 | 0.157080E 01 |
| 90. | 0.999998E-36 | 0.334974E 02 | 0.334974E 02 | 0.157080E 01 |
| 100. | 0.999998E-36 | 0.370713E 02 | 0.370713E 02 | 0.157080E 01 |
| 112. | 0.999998E-36 | 0.413045E 02 | 0.413045E 02 | 0.157080E 01 |
| 125. | 0.999998E-36 | 0.458188E 02 | 0.458188E 02 | 0.157080E 01 |
| 140. | 0.999998E-36 | 0.509320E 02 | 0.509320E 02 | 0.157080E 01 |
| 160. | 0.999998E-36 | 0.575886E 02 | 0.575886E 02 | 0.157080E 01 |
| 180. | 0.999998E-36 | 0.640668E 02 | 0.640668E 02 | 0.157080E 01 |
| 200. | 0.999998E-36 | 0.703811E 02 | 0.703811E 02 | 0.157080E 01 |
| 224. | 0.999998E-36 | 0.777756E 02 | 0.777756E 02 | 0.157080E 01 |
| 250. | 0.999998E-36 | 0.856245E 02 | 0.856245E 02 | 0.157080E 01 |
| 280. | 0.999998E-36 | 0.945926E 02 | 0.945926E 02 | 0.157080E 01 |
| 315. | 0.999998E-36 | 0.105171E 03 | 0.105171E 03 | 0.157080E 01 |
| 355. | 0.999998E-36 | 0.117861E 03 | 0.117861E 03 | 0.157080E 01 |
| 400. | 0.999998E-36 | 0.133734E 03 | 0.133734E 03 | 0.157080E 01 |
| 450. | 0.999998E-36 | 0.154936E 03 | 0.154936E 03 | 0.157080E 01 |
| 500. | 0.999998E-36 | 0.182520E 03 | 0.182520E 03 | 0.157080E 01 |
| 560. | 0.999998E-36 | 0.230389E 03 | 0.230389E 03 | 0.157080E 01 |
| 630. | 0.999998E-36 | 0.324966E 03 | 0.324966E 03 | 0.157080E 01 |
| 710. | 0.434437E 03 | 0.379392E 03 | 0.576779E 03 | 0.717864E 00 |
| 800. | 0.499816E 02 | 0.214695E 03 | 0.220436E 03 | 0.134207E 01 |
| 900. | 0.278194E 03 | 0.514693E 03 | 0.585064E 03 | 0.107527E 01 |
| 1000. | 0.149543E 04 | 0.187992E 03 | 0.150720E 04 | 0.125055E 00 |
| 1120. | 0.444356E 03 | 0.187990E 03 | 0.482486E 03 | 0.400227E 00 |
| 1250. | 0.437329E 03 | 0.155992E 03 | 0.464317E 03 | 0.342625E 00 |
| 1400. | 0.431232E 03 | 0.131269E 03 | 0.450769E 03 | 0.295494E 00 |
| 1600. | 0.425524E 03 | 0.109082E 03 | 0.439283E 03 | 0.250943E 00 |
| 1800. | 0.421604E 03 | 0.937284E 02 | 0.431897E 03 | 0.218756E 00 |
| 2000. | 0.418809E 03 | 0.823904E 02 | 0.426837E 03 | 0.194245E 00 |
| 2240. | 0.416404E 03 | 0.721105E 02 | 0.422602E 03 | 0.171474E 00 |
| 2500. | 0.414549E 03 | 0.636372E 02 | 0.419405E 03 | 0.152320E 00 |
| 2800. | 0.413024E 03 | 0.561205E 02 | 0.416819E 03 | 0.135050E 00 |

-continued

| | | | | |
|---|---|---|---|---|
| 3150. | 0.411771E 03 | 0.493840E 02 | 0.414722E 03 | 0.119361E 00 |
| 3550. | 0.410771E 03 | 0.434702E 02 | 0.413065E 03 | 0.105433E 00 |
| 4000. | 0.409988E 03 | 0.383395E 02 | 0.411776E 03 | 0.932427E-01 |
| 4500. | 0.409379E 03 | 0.339151E 02 | 0.410782E 03 | 0.826565E-01 |
| 5000. | 0.408945E 03 | 0.304186E 02 | 0.410074E 03 | 0.742464E-01 |
| 5600. | 0.408569E 03 | 0.270789E 02 | 0.409466E 03 | 0.661806E-01 |
| 6300. | 0.408260E 03 | 0.240114E 02 | 0.408966E 03 | 0.587462E-01 |
| 7100. | 0.408013E 03 | 0.212643E 02 | 0.408567E 03 | 0.520696E-01 |
| 8000. | 0.407819E 03 | 0.188432E 02 | 0.408254E 03 | 0.461720E-01 |
| 9000. | 0.407668E 03 | 0.167296E 02 | 0.408011E 03 | 0.410143E-01 |
| 10000. | 0.407560E 03 | 0.150438E 02 | 0.407838E 03 | 0.368951E-01 |
| 11200. | 0.407467E 03 | 0.134221E 02 | 0.407688E 03 | 0.329285E-01 |
| 12500. | 0.407394E 03 | 0.120194E 02 | 0.407572E 03 | 0.294945E-01 |
| 14000. | 0.407335E 03 | 0.107265E 02 | 0.407476E 03 | 0.263274E-01 |
| 16000. | 0.407280E 03 | 0.938165E 01 | 0.407388E 03 | 0.230308E-01 |
| 18000. | 0.407242E 03 | 0.833677E 01 | 0.407327E 03 | 0.204684E-01 |
| 20000. | 0.407215E 03 | 0.750150E 01 | 0.407284E 03 | 0.184194E-01 |

HIGH FREQUENCY TRANSMISSION FACTOR=0.999379E 00+J (0.999999E-18) 1000 THROAT RADIUS=0.285354E-01
AREA=0.255810E-02

SHAPE OF HORN

METERS

10 R( TH )L=0.15 RAD(M)=0.15 SCALE=0.07789 SHAPE=0.522

| AT LENGTH | RADIUS | AREA |
|---|---|---|
| 100 | 0.000000E 00, | 0.285354E-01, | 0.255810E-02 |
| 110 | 0.300000E-03, | 0.285930E-01, | 0.256844E-02 |
| 120 | 0.600000E-03, | 0.286511E-01, | 0.257888E-02 |
| 130 | 0.900000E-03, | 0.287095E-01, | 0.258942E-02 |
| 140 | 0.120000E-02, | 0.287684E-01, | 0.260005E-02 |
| 150 | 0.150000E-02, | 0.288277E-01, | 0.261078E-02 |
| 160 | 0.180000E-02, | 0.288875E-01, | 0.262162E-02 |
| 170 | 0.210000E-02, | 0.289477E-01, | 0.263255E-02 |
| 180 | 0.240000E-02, | 0.290083E-01, | 0.264359E-02 |
| 190 | 0.270000E-02, | 0.290693E-01, | 0.265472E-02 |
| 200 | 0.300000E-02, | 0.291308E-01, | 0.266596E-02 |
| 210 | 0.330000E-02, | 0.291927E-01, | 0.267730E-02 |
| 220 | 0.360000E-02, | 0.292550E-01, | 0.268875E-02 |
| 230 | 0.390000E-02, | 0.293178E-01, | 0.270030E-02 |
| 240 | 0.420000E-02, | 0.293810E-01, | 0.271195E-02 |
| 250 | 0.450000E-02, | 0.294446E-01, | 0.272371E-02 |
| 260 | 0.480000E-02, | 0.295087E-01, | 0.273558E-02 |
| 270 | 0.510000E-02, | 0.295732E-01, | 0.274755E-02 |
| 280 | 0.540000E-02, | 0.296381E-01, | 0.275963E-02 |
| 290 | 0.570000E-02, | 0.279035E-01, | 0.277182E-02 |
| 300 | 0.600000E-02, | 0.297693E-01, | 0.278412E-02 |
| 310 | 0.630000E-02, | 0.298356E-01, | 0.279653E-02 |
| 320 | 0.660000E-02, | 0.299023E-01, | 0.280905E-02 |
| 330 | 0.690000E-02, | 0.299695E-01, | 0.282168E-02 |
| 340 | 0.720000E-02, | 0.300371E-01, | 0.283443E-02 |
| 350 | 0.750000E-02, | 0.301051E-01, | 0.284729E-02 |
| 360 | 0.150000E-01, | 0.319542E-01, | 0.320779E-02 |
| 370 | 0.225000E-01, | 0.340997E-01, | 0.365302E-02 |
| 380 | 0.300000E-01, | 0.365617E-01, | 0.419954E-02 |
| 390 | 0.375000E-01, | 0.393629E-01, | 0.486770E-02 |
| 400 | 0.450000E-01, | 0.425293E-01, | 0.568232E-02 |
| 410 | 0.525000E-01, | 0.460903E-01, | 0.667373E-02 |
| 420 | 0.600000E-01, | 0.500790E-01, | 0.787881E-02 |
| 430 | 0.675000E-01, | 0.545323E-01, | 0.934238E-02 |
| 440 | 0.750000E-01, | 0.594916E-01, | 0.111189E-01 |
| 450 | 0.825000E-01, | 0.650029E-01, | 0.132744E-01 |
| 460 | 0.900000E-01, | 0.711173E-01, | 0.158891E-01 |
| 470 | 0.975000E-01, | 0.778916E-01, | 0.190604E-01 |
| 480 | 0.105000E 00, | 0.853886E-01, | 0.229060E-01 |
| 490 | 0.112500E 00, | 0.936779E-01, | 0.275692E-01 |
| 500 | 0.120000E 00, | 0.102836E 00, | 0.332234E-01 |
| 510 | 0.127500E 00, | 0.112949E 00, | 0.400788E-01 |
| 520 | 0.135000E 00, | 0.124110E 00, | 0.483906E-01 |
| 530 | 0.142500E 00, | 0.136422E 00, | 0.584679E-01 |
| 540 | 0.150000E 00, | 0.150000E 00, | 0.706857E-01 |
| 560 | 0.150000E 00, | 0.150000E 00, | 0.706858E-01 |

The efficiency of a horn driver combination may be computed from the following expression:

$$n = 100\, B^2 l^2 X_{M1} / [R_{dc}(X_{M1}^2 + X_{MM}^2) + B^2 l^2 X_{M1}]$$

$$X_{M1} = A/(1 - j\, C_{M1});$$

$$X_{MM} = jw\, M_{MD}$$

$C_{M1}$ = Compliance of front volume;
$M_{MD}$ = Moving mass of driver
A = Area of driver diaphragm;
l = length of coil conductor
B = Flux density through driver coil Thus a driver for a driven throat size which is optimum for high frequencies will not suffice for low frequencies. It is desirable, then, to utilize different drivers for low and high frequencies.

Two drivers may be coupled to the same horn throat in the following manner. The smaller driver is mounted to the throat with a radial slot around its edge. This slot opens into a volume to the rear of the driver on which is mounted the larger driver. The mass in this opening is large at the lowest frequency to be reproduced by the small driver, but forms a low pass filter with the compliance of the rear volume for the large driver according to the equivalent circuit shown in FIG. 8.

The combination can then be equipped with suitable crossovers to provide a uniform frequency response.

Below horn cutoff another driver must be provided. However, with the size limitations this driver generally will not be horn loaded. The radiation pattern must therefore open up allowing the radiation to become more and more spherical. Since, in most rooms, bounday absorption increases with frequency, the intensity at the listening position tends to stay uniform.

If the radiator is mounted so that its radiation will tend to be cylindrical, as with an inverted cone driven at the apex, there will still be assurance that the first sound heard will be the direct sound. The cylindrical effect may be emphasized by inserting a slower velocity medium at points further from the driven apex of the cone so that the delay will increase the cylindrical nature of the wave front. The delay increases as the distance downward increases. In effect, viewing the cone as a line source, the position of the cone moves back in reverse of the physical position.

The velocity of longitudinal waves of sound in an elastic solid is:

$$c_L = \{E/[\rho_p(1-\sigma^2)]\}^{\frac{1}{2}},$$

where E = Young's modulus, $\rho_p$ = density, $\sigma$ = Poisson's ratio

A bending wave in a plate propagates at:

$$c_B = (1.8hfc_L)^{\frac{1}{2}}$$

where h is the thickness of the plate and f is the frequency. Since the wavelength $\lambda$ is equal to $c_B/f$, the virtual length of the cone side decreases with frequency thus keeping its directivity relatively constant. This can be understood if the cone is viewed as a series of multiple sources following the directivity equation. In that equation, the term $\omega m/c$ will increase with root frequency rather than with frequency.

If a porous elastic solid is placed to surround the loudspeaker, such that the thickness of the solid increases moving from the plane of the loudspeaker cone apex to its base, the propagation delay in the material vs. that of air will produce a further tilting of the wavefront. If, however, the sound velocity is faster in the solid, the thickness variation must be reversed.

To reduce variations with frequency in the vertical direction all elements of the system are designed to have small vertical dimensions. Thus the space between them is minimized. In the preferred system, no vertical extent exceeds 14 cm. Perturbations in the vertical directivity can be derived according to the multiple source equation cited previously.

Thus at the highest frequency, 1.2 kHz affected by the 14 cm extent, the perturbation is less than 3 dB.

The low frequency driver is loaded into a box to baffle low frequencies. To increase low frequency efficiency a vented box is used, however, to maintain the small source spacing and symmetry, the vent consists of a slot arranged radially about the top of the box.

This arrangement is required since the vent represents an acoustic mass giving a first order roll-off to its output above the Helmholtz resonance of the box and vent. The roll-off is not sufficient to attenuate shorter wavelengths which would be affected by the size of the source and the distance between sources.

The following two articles published by the inventor are of interest as background information relating to speakers:

1. Speaker Performance, Pages 53–56 of Stereo Review Magazine of August 1974.
2. Psychoacoustics, Pages 25–27 of db Magazine of February 1976.

Thus, it is seen that this invention provides a compact loudspeaker system having greatly improved characteristics over loudspeaker systems of the prior art and which can be mounted in a room so as to reproduce sound.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

Figure 1:
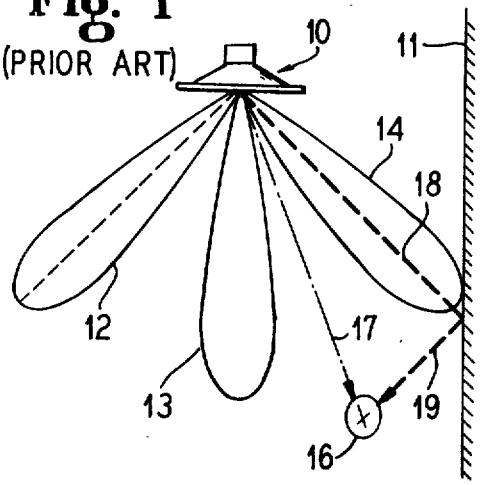
Fig. 1 (PRIOR ART)
FIG. 1 is a top plan view of a prior art speaker.

FIG. 1 is a top plan view illustrating a speaker 10 of the prior art mounted such that it has lobes 12, 13 and 14. A listener at location 16 receives a direct signal 17 and a reflected signal which is reflected from the wall 11 which follows the paths 18 and 19. In the condition of FIG. 1 of the prior art wherein the listener 16 is not on the main lobes 12, 13 and 14 of the speaker 10 it is possible that the reflected signal reaching him via paths 18 and 19 can be greater than the amplitude of the signal reaching him via the direct paths 17 and this will cause his attention to be directed to the reflecting surface 11 rather than to the position of the speaker 10. This is particularly undesirable in stereo reproduction and the result will be blurring and wandering of the stereo image since the lobes 12, 13 and 14 can vary as a function of frequency.

Figure 2:
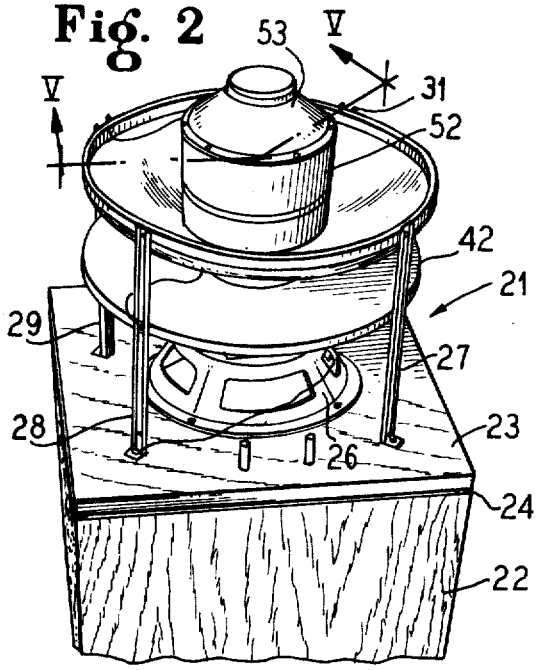
FIG. 2 is a perspective view of the speaker of the invention.
Figure 5:
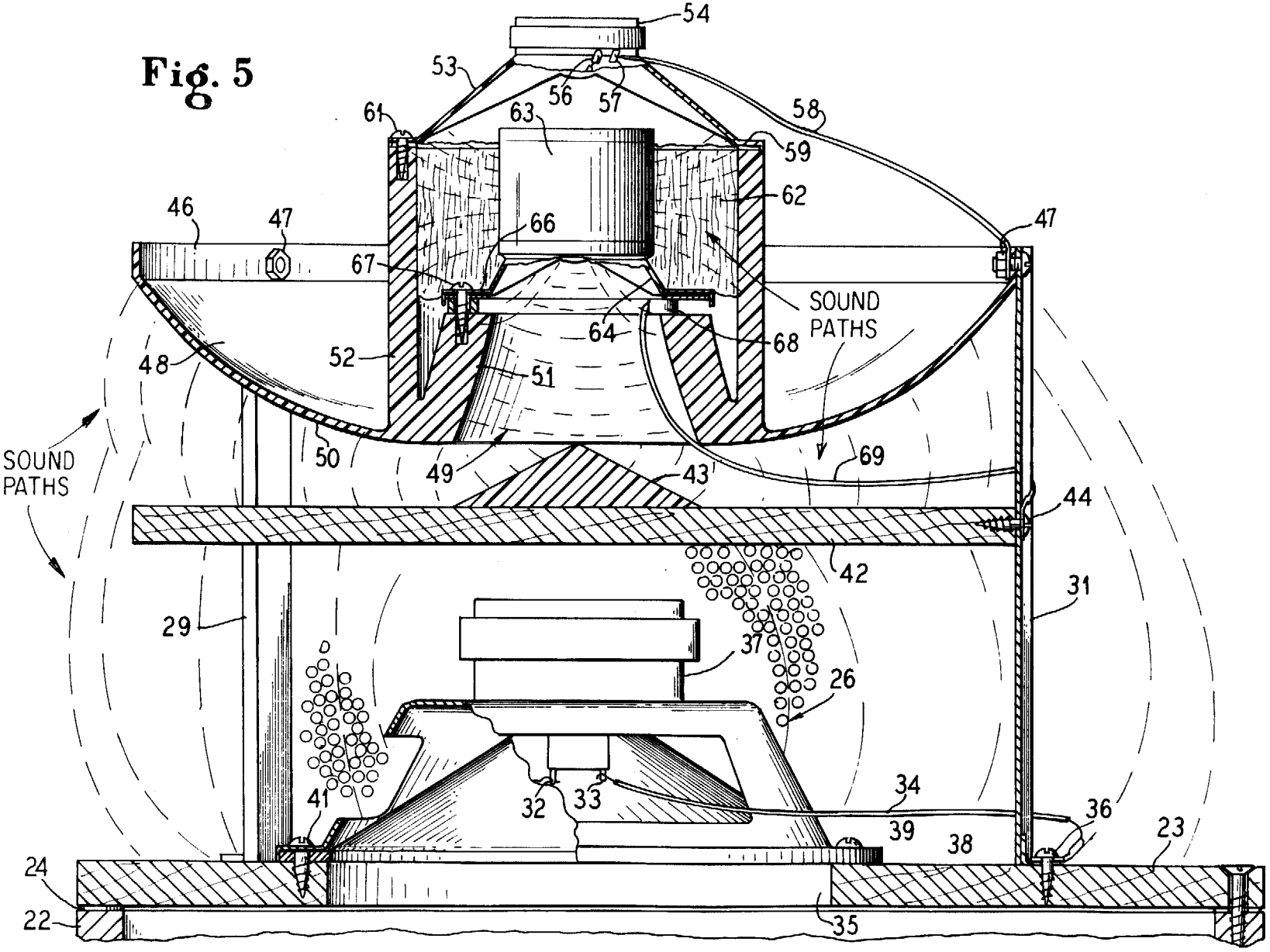
FIG. 5 is an enlarged sectional view of the speaker system of the invention.

The speaker of the invention is illustrated in FIGS. 2 and 5 and comprises a stand 22 which may be generally square in cross-section and has a top 23 which is spaced from the stand 22 by a gap 24 that is less than the thickness of the walls of the box and might be 0.0056 inches as is shown in FIG. 5. The stand 22 may be made of wood such as plywood and a low frequency speaker 26 is mounted over an opening 35 formed in the top 23 and its flange 38 is connected by screws such as 39 and 41 to the top 23 of the enclosure stand 22. The speaker driver 37 has input leads 32 and 33 which receive the electrical input to drive the speaker 26. The output of the speaker passes into the enclosure defined by the stand 22 and out in a generally radial pattern through the gap 24 at low frequencies and through openings in basket 26 at higher frequencies.

Metal standoff members such as 27, 28, 29 and 31 have their lower ends attached to the cover member 23 and support a disk member 42 by screws 44 at an intermediate position. An inverted conical portion 43 is attached to the disk member 42 at its center and faces the output of a combination high and mid-frequency horn according to the invention. The mid and high frequency horn portion comprises a cylindrical vertical portion 52 which supports a mid-frequency range speaker 53 on its upper end with the flange 59 of the speaker 53 connected by screws 61 to the upper end of the cylindrical portion 52. Fibreglass 62 is mounted in the confines of the cylindrical portion 52 and a high frequency speaker 63 has its flange 66 connected by screws 67 and standoffs 68 to a supporting portion 51 which extends up into the cylindrical portion 52 from the lower end thereof. A space is provided by the standoffs 68 and the upper end of portion 51 and this space or gap may be ⅛ inch, for example.

A radiating surface 50 of the horn 48 attaches to the cylindrical portion 52 and has its upper outer flange 46 connected by nuts and bolts 47 to the standoffs 27, 28, 29 and 31. As shown in FIG. 5, the driver 54 of mid frequency speaker 53 has input leads 56 and 57. The high frequency speaker 63 has an output conical portion 64. Power lead 69 and another lead, not shown, supplies input to speaker 63.

The surface 50 of the radiating horn 48 has the shape conforming to the prior printout on pages 9 and 10.

Figure 3:
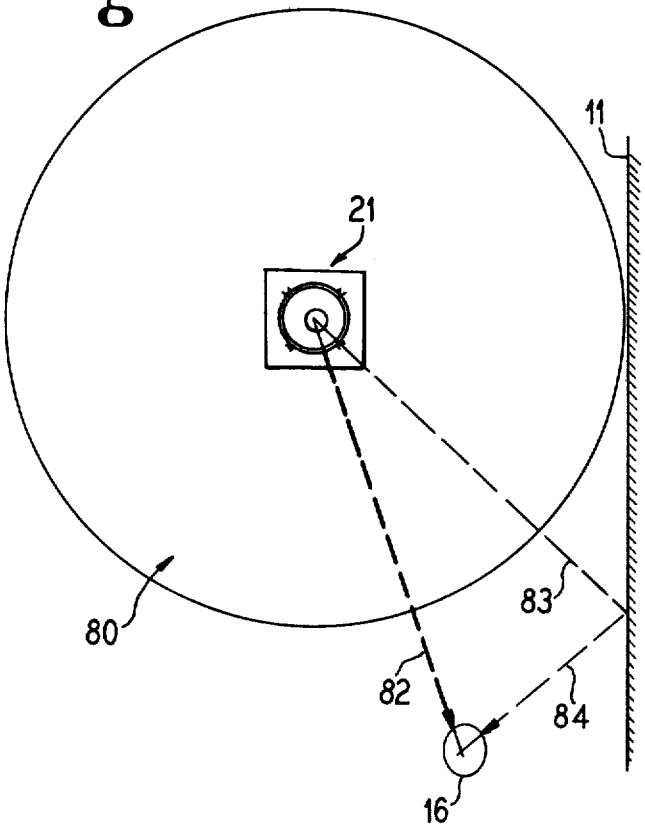
FIG. 3 is a top plan view of the speaker of the invention.
Figure 4:
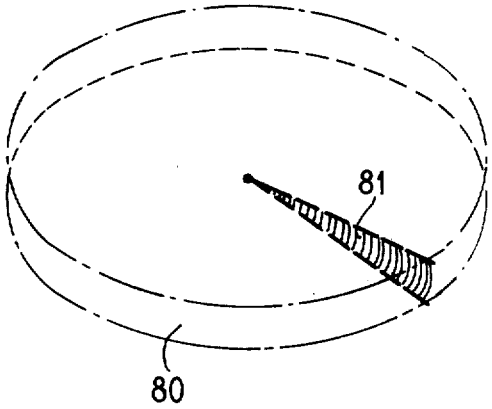
FIG. 4 illustrates the spherical sector pattern of the present invention.

The loudspeaker system according to the invention radiates as shown in FIGS. 3 and 4. FIG. 3, for example, is a top plan view and illustrates the radiation pattern 80 from the speaker system 21 of the invention which is substantially uniform in the horizontal plane such that the direct path 82 to a listener 16 will always arrive at the listener 16 before the indirect path 83 and 84 comprising a reflection from the wall 11 arrives at the listener. Also, the energy in the direct path 82 will always have greater amplitude than the indirect path at all frequencies.

FIG. 4 is a generally perspective view of the radiation pattern 80 and shows a sectional view 81 of the radiation between the disk 42 and the radiating surface 50 and illustrates that the radiation generally is uniform about 360° of the speaker in the horizontal plane.

Figure 7:
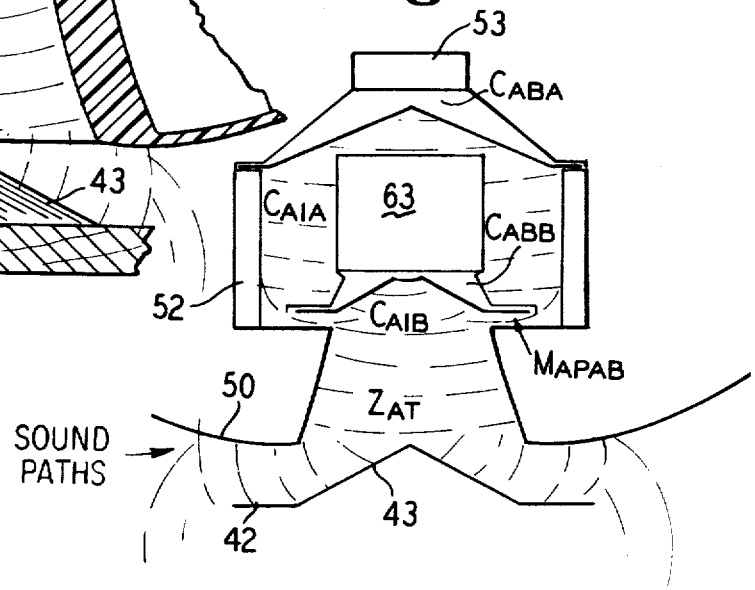
FIG. 7 is a schematic view of the preferred embodiment of the invention.

FIG. 7 is a section schematic view of the high frequency speaker 63 and the mid range speaker 53.

Figure 8:
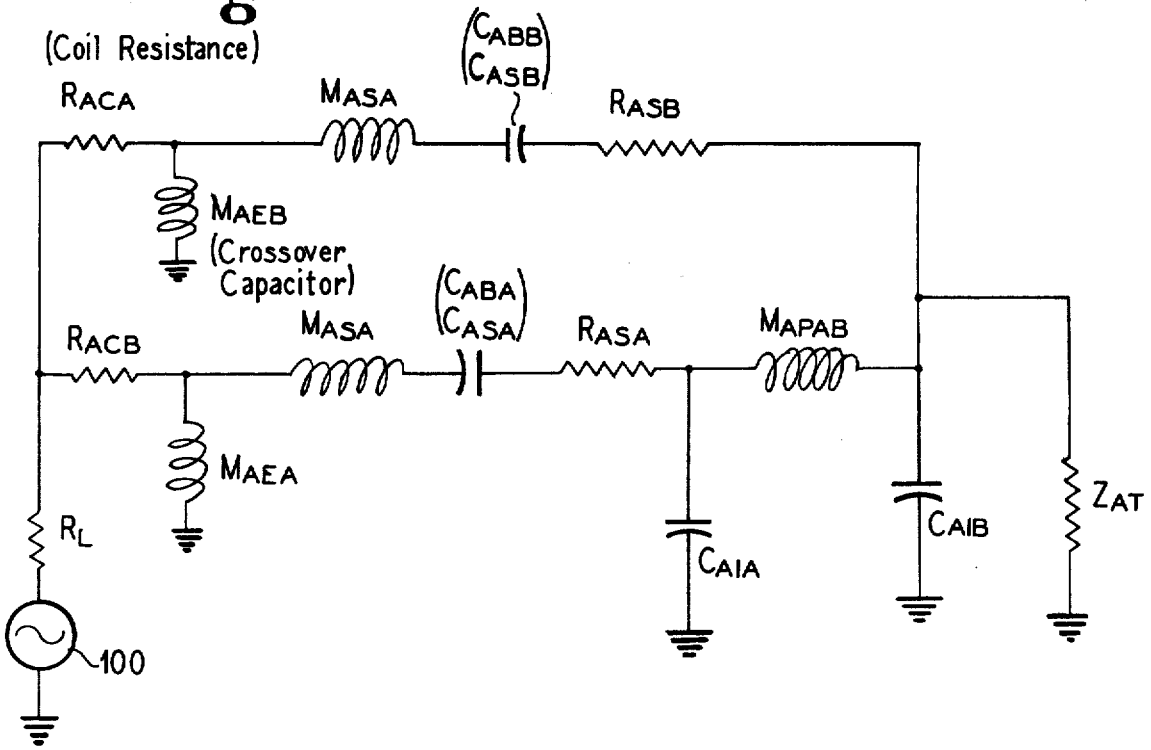
FIG. 8 is an electrical equivalent circuit for the speaker system of the invention.

FIG. 8 is the equivalent circuit of the speaker for the mid range and high frequency speakers. The schematic diagram of FIG. 8 illustrates a driving source 100 feeding the speakers 53 and 63 through a load resistance $R_L$ and the various elements of the schematic 8 are illustrated in conventional loudspeaker terms.

A particular speaker system constructed according to the invention had the following dimensions. Stand 22 and cover 23 were 13¾" by 13¾" and the low frequency speaker 26 was a 8 inch speaker. The disk 42 was mounted 4¾ inches above the top 23 and had a thickness of ½ inch.

The high frequency speaker 63 has a driver diameter of 2 1/16 inch. The cylindrical portion 52 had an inner diameter of 4¼ inches and had a thickness of ⅜ inches. The cone 43 was about 0.837 inch in height at its apex and the walls of the radiator 48 extended to a point 3½ inches above the surface of the disk 42. The diameter of the driver 57 of the mid frequency speaker 53 was 2⅜ inches.

From the mouth of the horn 48 to the gap 68 was 1½ inches and the height of the cylindrical member 52 was 3⅝ inches.

It is to be noted that the speaker system of the invention is mounted in a very compact vertical space and in a preferred embodiment the vertical extent between sources radiating the same frequency did not exceed 14 cm. Also, by the coupling of the high frequency speaker 63 and the mid frequency speaker 53 such that the outputs of both speakers pass through the opening formed in the member 51 and impinge upon the conical member 43 and are then uniformly radiated in the horizontal plane from the horn 50 and the disk 42 results in uniform sound distribution in 360° results in an improved response over speakers of the prior art.

Figure 6:
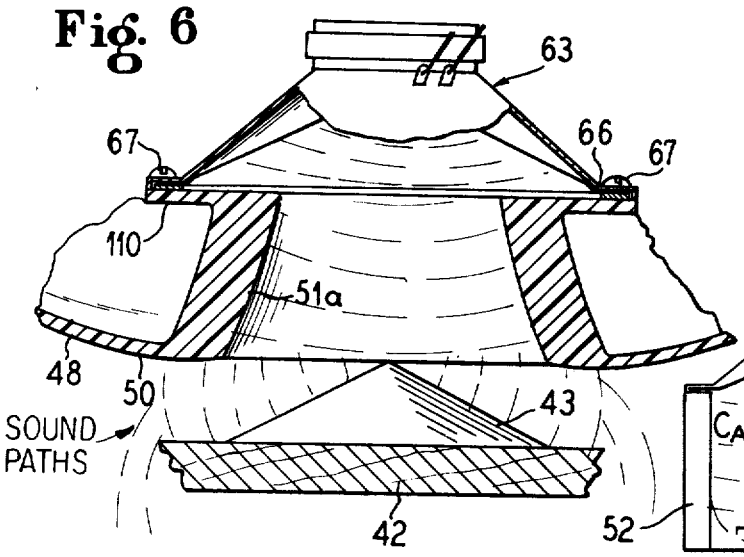
FIG. 6 illustrates a modification of the invention.

FIG. 6 illustrates a modification of the invention wherein the mid frequency speaker 53 is eliminated and the high frequency speaker 63 is mounted to the radiating horn 48 by generally cylindrical throat portion **51*a* which has a height of 1¾ inches above the apex of the conical portion 43. The flange 66 of speaker 63 is connected by bolt 67 to a rim 110 formed about the upper portion of the supporting throat 51*a***.

It is to be realized that the development of the curve of the radiating horn 48 can take various shapes and in a particular embodiment the curvature defined on pages 9 and 10 were used.

The lower end of the output member 51 has chosen to have a diameter of two times the height of cone 43 and the spacing of disk 42 from the output. In a preferred embodiment, the inner diameter of the output member was 1.674 inches and the height of cone 43 was 0.837 inches. The inverted cone 43 may be of solid material so as to properly develop the horn area.

The inverted cone of the low frequency speaker 26 may be surrounded by a porous elastic material changing in diameter toward the base such as to vary the propagation velocity along the vertical cross section resulting in bending of the wavefront toward the cylindrical shape desired.

Although the invention has been described with respect to preferred embodiments, it is not to be so limited, as changes and modifications may be made which are within the full intended scope as defined by the appended claims.

References for symbols in FIG. 7 and FIG. 8 are defined in the following publication:

Beranek, L. L. *Acoustics*, Mcgray Hill, New York (1954)

I claim as my invention:

1. A loudspeaker system which has an output such that its frequency response at any angle at which a listener is positioned is uniform comprising,
   - an enclosure formed with a slot near its top which substantially extends about its periphery,
   - a low frequency speaker attached to the top of said enclosure to direct sound energy into said enclosure and out said slot,
   - a horizontal planar member supported above said low frequency speaker,
   - a convex radiating horn surface supported above said horizontal planar member,
   - a hollow driving member with its center opening joined to said radiating horn, and
   - a second speaker mounted to the top of said hollow member to supply sound energy through said hollow member such that it impinges on said horizontal planar member and radiates outwardly in the horizontal plane between said radiating horn and said horizontal planar member.

2. A system of electroacoustic transducer audio frequency drivers combined with acoustic transmission paths, all arranged symmetrically and in close proximity on the vertical axis of the system, and consisting of a vented box member and being square in cross-section, a flat top cover member of similar shape to the said cross-section of said box spaced a distance from said box less than the thickness of the walls of said box and mounted above said box, a low audio frequency electroacoustic driver whose cross-section is generally circular mounted on the flat top cover member and centered on the axis of symmetry over an opening formed in said flat top cover member, a disc shaped member mounted above and in a close vertical proximity to said low frequency driver radiation load, a high frequency electroacoustic driving means mounted above said disc-shaped member and said disc-shaped member forming one side of an acoustic transmission path for said high frequency driving means, a central hollow vertical member connected to and blending into a geometrically horizontally radiating surface member and the combination mounted above aid disc-shaped said and shaped with said disc-shaped member to form an acoustic transmission path which provides an acoustic impedance transformation between said high frequency driving means which is mounted on the top of said hollow vertical member so that said combination forms an opening for the transmission path with said high frequency driving means radiating into said acoustic transmission path, such that the combined radiation of said low frequency driver and said high frequency driving means will concentrate the radiated sound energy into a horizontal plane defined by the position of a listener's ears, and such that the sound intensity in the path directly from the system to the listener's ears is such that the intensity in any horizontal direction does not vary with direction and such that the sound intensity along the path directly from the system to the listener's ears is always greater than the intensity of any sound from the system reflected from a wall to the listener's ears.

3. A system as in claim 2 where the low frequency dynamic driver is mounted such that it radiates downwardly.

4. A system as in claim 2 where the distances between all radiating surfaces are reduced in the vertical direction so as to minimize variations in the radiation pattern relative to movement vertically around the system, thus reducing the possibility of reflections due to vertical lobes.

5. A system as in claim 2 where the acoustic transmission path for the high frequency driving means is shaped to form a radial horn with enlarging cross-sectional areas for downward movement on the hollow member and for outward movement between said horizontally radiating surface member and said disc shaped member.

6. A system as in claim 5 where said high frequency driving means includes a highest frequency electroacoustic driver mounted slightly above the top of said central hollow member and a radial gap formed between the mounting flange of said highest frequency driver and the top of said hollow member, and a second hollow member having an inside diameter greater than said central hollow member and extending above it to form a cavity on the side of the highest frequency electroacoustic driver opposite to the transmission path and communicating acoustically with said transmission path only through said radial gap, a middle high frequency driver mounted to the top of said second hollow member such that it radiates into said transmission path via said cavity and said radial gap.

7. A system as in claim 6 wherein said cavity contains damping material.

* * * * *